US011796253B2

(12) United States Patent
Masten, Jr.

(10) Patent No.: US 11,796,253 B2
(45) Date of Patent: Oct. 24, 2023

(54) REFRACTORY FURNACE STRUCTURE

(71) Applicant: James William Masten, Jr., Everett, WA (US)

(72) Inventor: James William Masten, Jr., Everett, WA (US)

( * ) Notice: Subject to any disclaimer, the term of this patent is extended or adjusted under 35 U.S.C. 154(b) by 0 days.

(21) Appl. No.: 17/706,510

(22) Filed: Mar. 28, 2022

(65) Prior Publication Data

US 2022/0221224 A1 Jul. 14, 2022

Related U.S. Application Data

(63) Continuation of application No. 17/347,428, filed on Jun. 14, 2021, now Pat. No. 11,287,188.

(60) Provisional application No. 63/038,862, filed on Jun. 14, 2020.

(51) Int. Cl.

| | |
|---|---|
| ***F27D 1/00*** | (2006.01) |
| ***F27D 1/08*** | (2006.01) |
| ***F27D 1/02*** | (2006.01) |

(52) U.S. Cl.

CPC ..... *F27D 1/004* (2013.01); *F27D 1/003* (2013.01); *F27D 1/0009* (2013.01); *F27D 1/0023* (2013.01); *F27D 1/025* (2013.01); *F27D 1/08* (2013.01)

(58) Field of Classification Search

CPC ..... F27D 1/0009; F27D 1/0023; F27D 1/003; F27D 1/004; F27D 1/025; F27D 1/08

USPC ..... 110/336, 337, 338, 308; 266/241, 249, 266/250, 252, 280, 286

See application file for complete search history.

(56) References Cited

U.S. PATENT DOCUMENTS

| | | | | |
|---|---|---|---|---|
| 1,670,490 A * | 5/1928 | Bigelow | F27D 1/004 52/506.03 |
| 2,222,978 A * | 11/1940 | Kiren | F27D 1/025 266/214 |
| 2,294,788 A * | 9/1942 | Longenecker | F27D 1/004 52/506.03 |
| 4,406,944 A * | 9/1983 | Crain | H05K 3/1291 392/416 |
| 10,682,585 B2 | 6/2020 | Masten, Jr. | |
| 10,717,933 B2 | 7/2020 | Masten, Jr. | |
| 10,718,527 B2 | 7/2020 | Masten, Jr. | |
| 10,738,368 B2 | 8/2020 | Masten, Jr. | |
| 11,045,755 B2 | 6/2021 | Masten, Jr. | |

FOREIGN PATENT DOCUMENTS

| | | | |
|---|---|---|---|
| CN 201890953 * | 7/2011 | H01L 21/67115 |

* cited by examiner

*Primary Examiner* — Jessee R Roe
*Assistant Examiner* — Michael Aboagye

(57) ABSTRACT

A furnace structure includes a roof assembly of at least one layer of refractory material, and a metal plate that covers the at least one layer of refractory material and is configured to dissipate heat from the furnace structure; a plurality of sidewalls fixed to the roof, each of the sidewalls comprising refractory material at an interior surface and a metal wall plate at an outer surface; and a plurality of infrared emitters disposed in an opening in at least one of the refractory material of the sidewalls or the refractory material of the roof.

19 Claims, 12 Drawing Sheets

REFRACTORY FURNACE STRUCTURE

CROSS-REFERENCE TO RELATED APPLICATION

This application is a continuation of U.S. application Ser. No. 17/347,428 filed Jun. 14, 2021, and issued as U.S. Pat. No. 11,287,188 on Mar. 29, 2022, which claims the benefit of U.S. Provisional Application No. 63/038,862, filed Jun. 14, 2020, the contents of which are incorporated herein by reference in their entirety.

BACKGROUND

There has been a rapid evolution of technology in materials used for thermal isolation barriers. Yet, these advancements have not significantly affected the many industrial processes used within the United States or the rest of the world. Chief among the issues faced by these processes is the minimization of heat loss from high-temperature industrial processes which involve molten materials of various types.

Conventional industrial applications of thermal isolation barriers for processing medium to large sized parts use ceramic refractory materials that are mixed with cement to form a refractory concrete and cast in place. Suspended ceilings or roofs are cast with embedded ceramic suspension anchors physically attached to external structural supports above the roof. Ceramic suspension anchors are used because their coefficients of expansion are similar to the ceramic refractory. Dissimilar coefficients would cause separation and would break any bonds between the refractory and the anchors as the materials were heated and cooled over operational cycles.

Attempts have been made to create three-dimensional anchors from metallic materials that have superior tensile strengths as compared to ceramic materials. Because of their very different expansion rates, these metallic three-dimensional anchors will break their bonds to the ceramic refractory but their complex geometries remain embedded within the cast material and typically will not allow the refractory to actually break free and fall.

Cast refractory materials are developed to exhibit good adhesion and cohesion properties as well as a low thermal conductivity and an ability to withstand very high temperatures. Since these goals are somewhat contradictory, cast refractory materials are typically a compromise that results in thermal conductivity that is about one to two orders of magnitude lower than the thermal conductivity found in materials thought of as thermal conductors. In addition, materials in the concrete portion of the castable refractory materials have different coefficients of thermal expansion (CTE), and the CTEs of the concrete materials are different from the CTEs of refractory materials. The different CTEs cause the castable refractory materials to crack over time, causing substantial thermal losses and ultimately requiring replacement at regular intervals, typically on the order of a few years.

BRIEF SUMMARY

The present disclosure describes a ceramic refractory structure that overcomes one or more of the disadvantages of conventional thermal chambers that use cast refractory materials.

Embodiments of the present disclosure include a high-temperature roof suspension system that includes refractory materials with substantially reduced thermal losses as compared to typical cast refractory roof systems. Embodiments of the present disclosure may reduce thermal losses by an order of magnitude or more. Embodiments may benefit from the relatively high strength, durability and longevity of metallic components with rates of expansion that differ dramatically from the expansion rates of the insulating refractory materials, while minimizing the destructive effects of the relative movement between metal and refractory materials by temperature cycling.

In an embodiment, a furnace structure comprises a roof assembly of at least one layer of refractory material, and a metal plate that covers the at least one layer of refractory material and is configured to dissipate heat from the furnace structure, a plurality of sidewalls fixed to the roof, each of the sidewalls comprising refractory material at an interior surface and a metal wall plate at an outer surface, and a plurality of infrared emitters disposed in an opening in at least one of the refractory material of the sidewalls or the refractory material of the roof.

The furnace structure may be configured to be repeatedly separated from and placed in contact with a floor to introduce and remove parts to and from the furnace structure.

The roof assembly may be configured to support the plurality of sidewalls when the furnace structure is separated from the floor. The roof assembly may include a plurality of structural support beams that are coupled to support beams of the sidewalls. The roof assembly and the plurality of sidewalls may not have any doors or access ports. A plurality of sidewall suspension rods may couple the roof assembly to a refractory base layer that is disposed at a base of the plurality of sidewalls.

In an embodiment, the at least one layer of refractory material includes a first layer of refractory boards and a second layer of refractory boards, and seams between adjacent boards of the first layer of refractory boards are staggered with respect to adjacent boards of the second layer of refractory boards.

In an embodiment, the at least one layer of refractory material includes a first layer of refractory boards and a second layer of refractory boards, joints between adjacent boards of the first layer of refractory material are ship-lapped, and joints between adjacent boards of the second layer of refractory material are ship-lapped.

In an embodiment, the furnace structure further includes a plurality of roof suspension rods that suspend a lowermost layer of the at least one layer of refractory material from the metal plate in the roof assembly, and the metal plate is thermally coupled to the roof suspension rods so that the metal plate dissipates heat received from the roof suspension rods when the furnace is heated.

The furnace structure may have a footprint of at least four square feet, and an operating temperature of at least 1000° F.

Embodiments transfer the weight-bearing loads to an external skeletal structure of plates and/or beam or tube structures that can be constructed of non-temperature-rated materials such as aluminum or mild steel.

Embodiments of the present disclosure may be built using pre-cast or extruded refractory boards or structures that are stacked or layered to obtain a sufficient thickness of material necessary to minimize thermal losses. The additional layers may be stacked on the bottom layer relative to the forces of gravity. The bottom layer may be subject to a machining process that results in a pocket for a suspension anchor that may be a metallic material. In an embodiment, the structure of the pocket is such that the pocket accommodates the three-dimensional expansion of the metallic suspension member without affecting the load-bearing relationship between the refractory mass and the metallic suspension member. The precision of the machined refractory board components can provide a minimal thermal-energy-loss system for many industrial processes.

In an embodiment, a high temperature containment structure includes a roof assembly including at least one layer of refractory material that includes a first layer of refractory material, a plurality of sidewalls, a plurality of pockets disposed in the first layer of ceramic refractory material, each pocket including a retainer that is spaced apart from sides of the pocket by gaps when the roof assembly is at room temperature, an upper plate disposed above the first layer of refractory material, and a first plurality of suspension rods that pass through first holes in the at least one layer of refractory material and the upper plate, wherein the plurality of suspension rods mechanically couple the retainers to the upper plate to retain the at least one layer of refractory material.

The containment structure may include at least one infrared radiant emitter disposed in an opening in the at least one layer of refractory material. The opening may further comprise a ceramic material with a passband in the infrared frequency spectrum that corresponds to a frequency of infrared energy output from the at least one infrared radiant emitter.

The containment structure may include a second plurality of suspension rods that extend from the plate in a base of the containment structure and support a ceramic refractory wall. In an embodiment, the base includes a second layer of refractory material, and the second plurality of suspension rods mechanically couple second retainers to the base to retain the second layer of refractory material. In an embodiment, the ceramic refractory wall includes at least one layer of refractory material disposed between the second plurality of suspension rods and an interior space of the containment structure.

In an embodiment, each pocket of the plurality of pockets has a first channel with a first width and a second channel with a second width that is less than the first width, and the first channel includes a thrust surface that interfaces with a corresponding thrust surface of the retainer. A plurality of refractory plugs may be respectively disposed in the plurality of pockets, wherein each retainer is disposed in a space between a respective plug and an upper surface of a respective pocket.

In an embodiment, the containment structure rests on a floor so that the containment structure can be lifted from the floor, or the floor can be lowered from the containment structure, to load and unload parts from the containment structure. The upper plate may be a metal material that extends across the roof of the containment structure. The structure may further include a plurality of metal beams coupled to the upper plate, wherein the metal beams provide sufficient structural support to the containment structure to support the weight of the containment structure, and a plurality of metal wall plates coupled to the upper plate that prevent loading and unloading parts to the containment structure from sides of the containment structure.

In an embodiment, a footprint of an interior space of the containment structure is at least four square feet. The containment structure may have an operating temperature of at least 1000° F., and the suspension rods and the retainer may be made of steel materials. The ceramic refractory material may be a porous fiber material.

BRIEF DESCRIPTION OF THE DRAWINGS

The accompanying drawings are intended to convey concepts of the present disclosure and are not intended as blueprints for construction, as they are not necessarily drawn to scale: the drawings may be exaggerated to express aspects of unique detail. However, the foregoing aspects and many of the attendant advantages of embodiments of this disclosure will become more readily appreciated by reference to the following detailed descriptions, when taken in conjunction with the accompanying drawings, wherein:

FIG. 7*a* shows a plug-retainer-rod subassembly, FIG. 7*b* is an exploded side view of the same components as FIG. 7*a*, and FIG. 7*c* is a view of a retainer with the suspension rod that illustrates a rod head in contact with a retainer.

DETAILED DESCRIPTION

Figure 1:
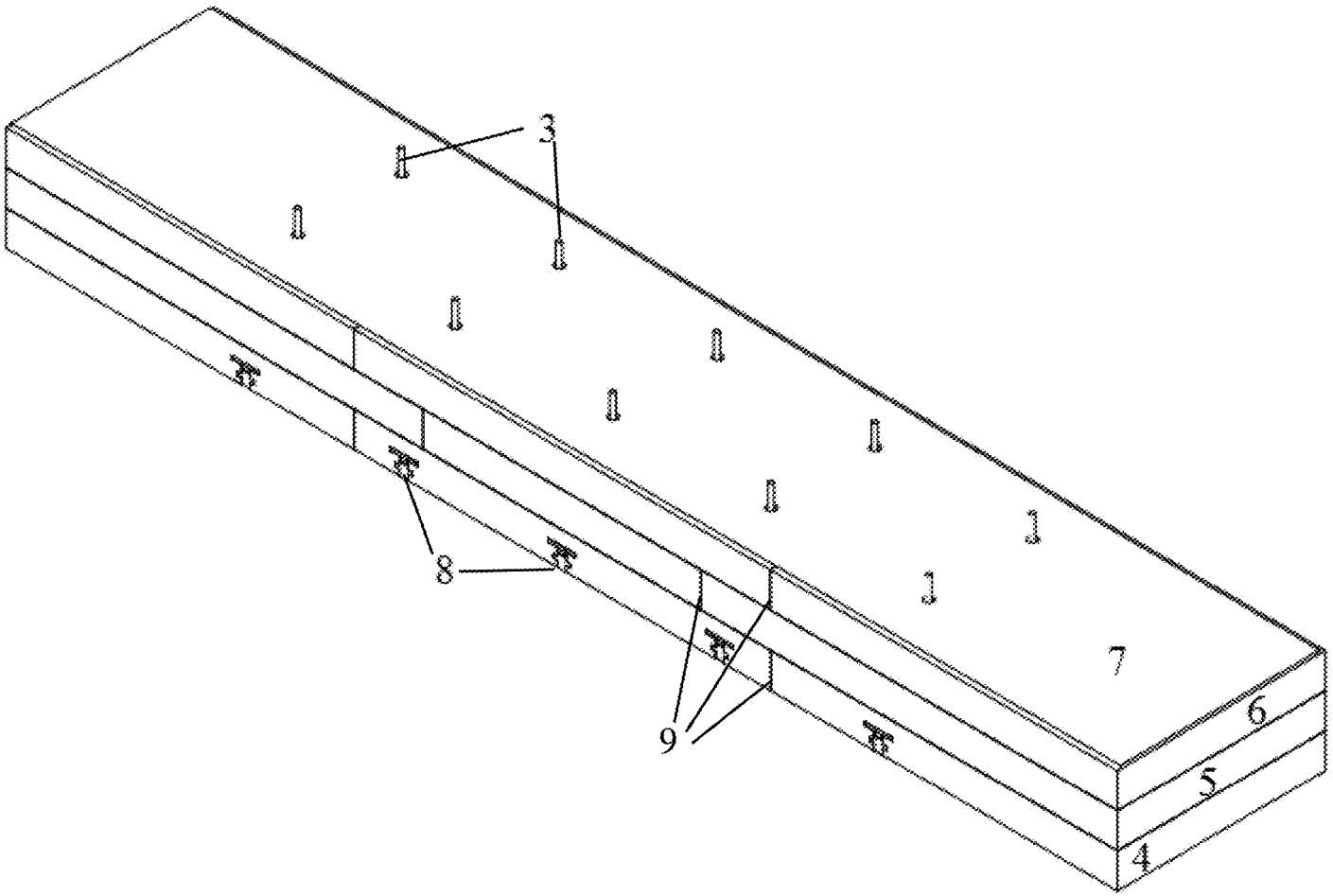
FIG. 1 shows an orthogonal view of an embodiment of a stacked system of refractory, with intra-layer board seams staggered between layers, which may prevent loss of thermal energy at the joint seams.

The following list provides specific descriptions and examples of items that are present in the embodiments illustrated by the figures. The descriptions in the list are illustrative of specific embodiments, and should not be construed as limiting the scope of this disclosure.

| Reference Numerals | Description |
|---|---|
| 1 | Retainer |
| 2 | Refractory plug |
| 3 | Suspension rod |
| 4 | First refractory board layer |
| 5 | Second refractory board layer |
| 6 | Third refractory board layer |
| 7 | Cover plate |
| 8 | Pocket |
| 9 | Seams between refractory boards |
| 10 | Ship-lapping used in refractory layers |
| 11 | Cutout used in some refractory layers to mount radiant source emitters and/or infrared-transmissive windows |
| 12 | Internal portion of pocket 8 |
| 13 | Hole |
| 14 | Roof assembly |
| 16 | High temperature containment structure |
| 20 | Roof plate |
| 21 | Roof support beams |
| 22 | Wall of exterior structure |
| 23 | Wall and foundation structure beams |
| 24 | Refractory base |
| 25 | Layer of inner refractory wall |
| 28 | Thrust surface of pocket 8 |
| 31 | Thrust surface of retainer 1 |
| 50 | Infrared radiant emitter |
| 52 | Coiled wire |
| 54 | Retaining screw made of machinable ceramic refractory |
| 56 | Metal backing/mounting plate |
| 58 | Temperature sensor |
| 60 | Center coil of the coiled wire |
| 62 | Temperature sensor leads |
| 64 | Castable ceramic refractory or putty material |
| 66 | Ceramic fibrous block refractory |

Numerous specific details are set forth in the following description to provide a thorough understanding. These details are provided for the purpose of example and embodiments may be practiced according to the claims without some or all of these specific details. For the sake of clarity, technical material that is known in the technical fields related to this disclosure has not been described in detail so that the disclosure is not unnecessarily obscured.

Embodiments of the present disclosure may be created by appropriately configuring the interface of materials of dissimilar expansion rates to work in harmony to effectively use readily available high-temperature, high-strength, moderately highly thermally conductive materials; low-strength, high-temperature, very low thermally conductive materials; and moderately high-strength, low-temperature, highly thermally conductive materials to realize working structures of unrestricted size to exhibit arbitrarily low thermal losses while providing very high temperature containment of the internal working space.

Embodiments of the present disclosure include preparing an extruded or molded refractory board or complex shape to present an internal load-bearing surface. The preparation includes creating a pocket 8 capable of housing and shielding a metallic load-bearing surface 31 as part of a retainer 1, with provisions in the machined dimensions to accommodate three directions of temperature-driven expansion.

Additionally two applications are revealed. The first is the application of unambiguous support of relatively large compressive loads, enabling assembly of arbitrarily thick refractory structures. The second application relates to the use of high temperature-tolerant, low-cost suspension materials with large and extremely large coefficients of expansion without penalty.

Embodiments of this disclosure may benefit from the precision capabilities of off-site extruded and pressure-formed fibrous refractory in a multi-layer realization to outperform cast-in-place refractory materials at substantial labor, material and operational energy savings.

Embodiments include high temperature-tolerant, weight-bearing supporting materials 1,3 that support high-temperature preformed ceramic fiber boards and/or structures (4, 5, 6, 24, 25) used to create a high-temperature containment structure 16. The containment structure 16 may be an oven, or a furnace in which some particular thermophysical reaction or process is performed. These thermophysical reactions may include gasification of materials or heat treatment of metals, such as melting, casting, solutionizing, annealing, and artificial aging in various combinations, or the treatment of glass including tempering and bending. The benefit to this technique is that high-temperature tolerant materials that have relatively high structural properties at elevated temperatures typically have larger coefficients of thermal conductivity and of thermal expansion than materials with very low coefficients of thermal conductivity which have correspondingly low strength at high temperatures. Embodiments may include pockets 8 with thrust surfaces 28 where the loads applied compressively to the insulating boards 4, 5, 6, 24 are transferred to the high-temperature tolerant materials, such that the physical changes to either the supporting materials or the insulating materials from large changes in temperature do not result in any significant degradation of the materials or structure.

Machining processes may be used to form pockets 8 where the ceramic fibrous materials are removed so that a retainer 1 can be fit into the machined pocket 8 along with a thermal energy-shielding refractory plug 2 that will serve to reduce the thermal energy applied to the retainer 1. Yet as the retainer 1 heats up and expands, the growth in size along any dimension will not cause thermally induced fractures in the fibrous ceramic board 4, 24 with its reduced thermal expansion and limited thermally driven physical growth.

Embodiments may provide a gap between retainer 1 pocket 8 and between suspension rods 3 and holes 13 to allow the suspension rods and retainers to expand at increased temperatures without colliding with the refractory material. In an embodiment, the length, width and height of pockets 8 may exceed the length, width and height of the strength member 1 by at least 105% of the product of the thermal expansion coefficient multiplied by the length, width and height of the strength member 1 plus the dimensions of the plug 2 rounded up to the nearest eighth of an inch.

The pocket 8 in the fibrous ceramic board may be located so that the compressive integrity of the fibrous board 4, 24 is not compromised. For example, in an embodiment, the entire vertical height of the pocket 8 is located in approximately the lower half of the thickness of the fibrous board 4, 24. Enough of the thickness of the ceramic board 4, 24 may be uncompromised and retain enough load-bearing capacity above the load-bearing retainers 1 to equal the load rating of the ceramic board multiplied by the thickness of the retained board above the load-bearing retainers to equal the estimated load plus at least 5%.

A hole 13 is provided through the pocket 8 to enable the installation of the suspension rod 3 and machine a shoulder to retain the fibrous board plug 2 that closes-off the pocket 8 and limits the heat flow to the retainer 1 and the suspension rod 3. This enables physical access to the board internal pocket 8 area where the retainer 1 component is located.

To prevent the escape of thermal energy through this path, successive layers of fibrous boards 4, 5, 6 may be placed such that seams between boards on a layer do not line up with seams 9 between boards on different layers and/or boards on the same layer. Offset seams have an advantage of reducing thermal losses of a multi-layer embodiment. In some embodiments, a thermal resistant mortar such as a ceramic refractory mortar may fill the seams 9 to further reduce thermal losses.

In addition, the boards may be ship-lapped (see FIGS. 5 and 6*a*) or machined with inter-locking steps. Each layer includes pass-through holes that allow the suspension rods 3 to pass through insulating layers 4, 5, 6 to the external skeleton of either beam 21, tube 23 or plate 7,20 structures that make up the exterior load-carrying structure of the thermal energy containment system.

The thermal energy transfer path of the suspension rods 3 is limited by the shielding refractory pocket 8 and plug 2. But in an embodiment, the passed-through thermal energy is dissipated to an external skeleton (see FIG. 10) as a heat sink. The external skeleton may be designed to conduct away and dissipate to the surrounding air in the local environment the combined thermal energy passed by all the suspension rods 3 and leaked by the fibrous boards 4, 5, 6, 24, 25 to the external skeleton. In an embodiment, the external skeleton has its own thermal isolation coating or cover and may be connected by heat pipe structures to efficiently move the thermal energy using a near isothermal process to a remote heat sink or a thermal energy storage system for recovery or reuse. Such a system would improve the operating environment of a foundry and potentially provide a significant cost savings through the reuse of recovered thermal energy.

The thermal skeleton may capture, conduct and dissipate or transfer all of the thermal energy with a minimum of temperature growth above ambient such that the temperature of the external skeleton does not increase to the point where the load-bearing ability of the skeleton is diminished below a safety factor of 10, including the additional loading of maintenance and retrofit.

Figure 2:
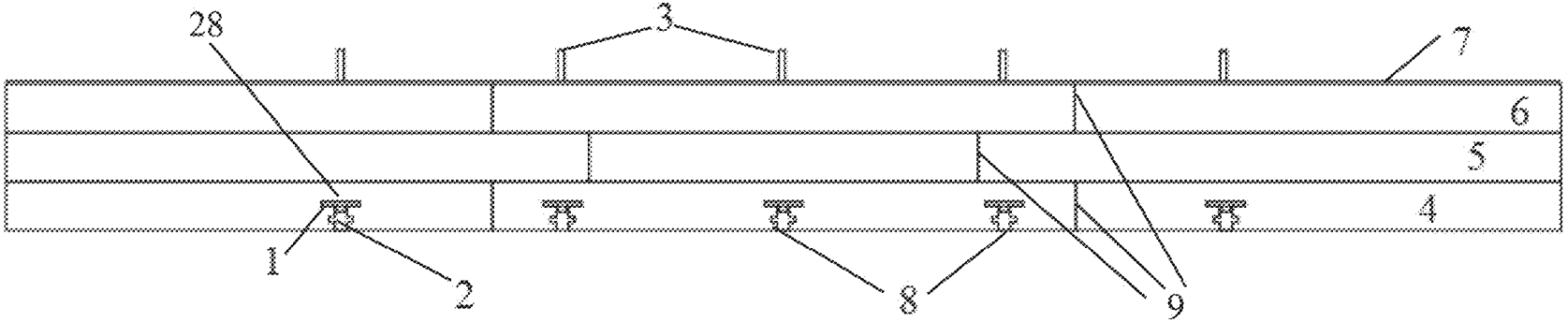
FIG. 2 shows a side view of the stack presented in FIG. 1. On the bottom layer there are plugs 2 filling pockets 8 where the suspended refractory retainers 1 are fitted which are supported by the suspension rods 3 shown protruding from the top layer.
Figure 3:
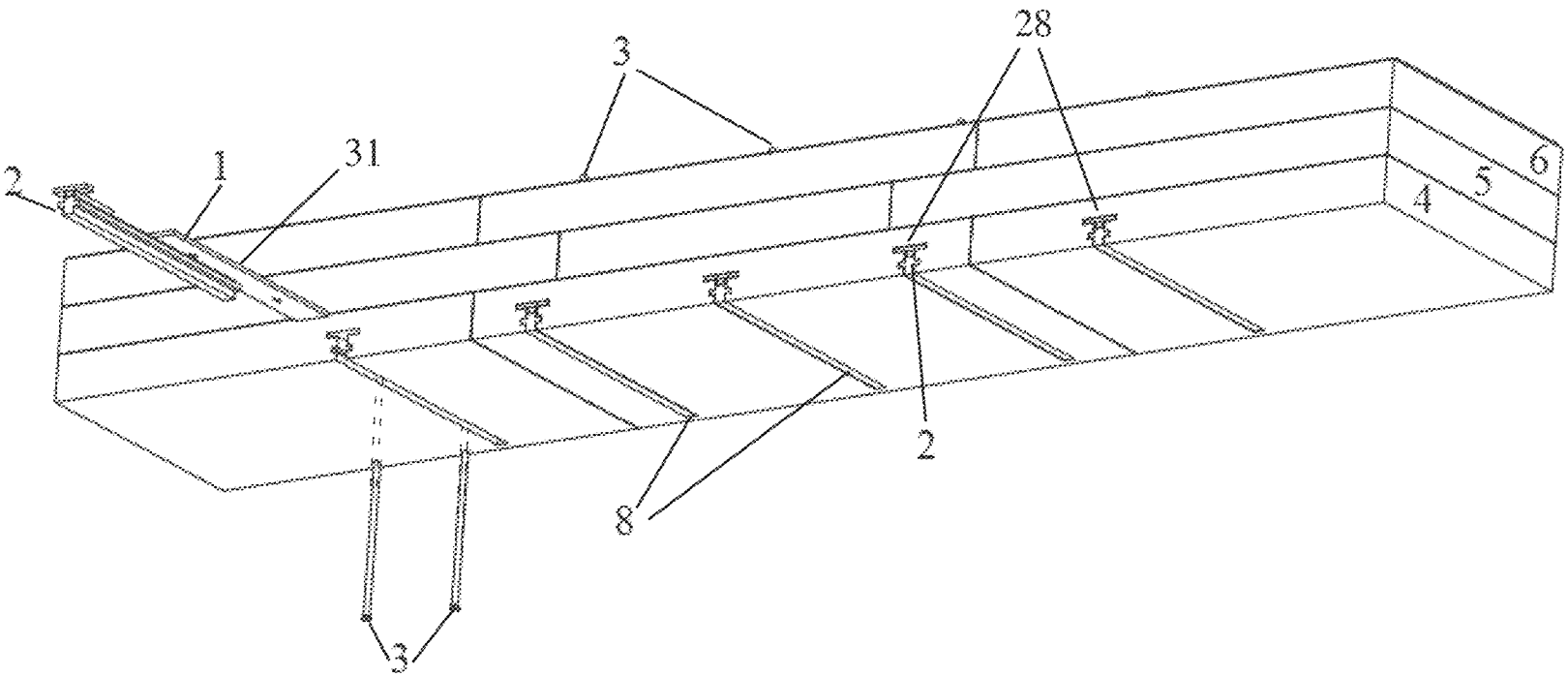
FIG. 3 illustrates how components are inserted into the machined pocket within the refractory.
Figure 4:
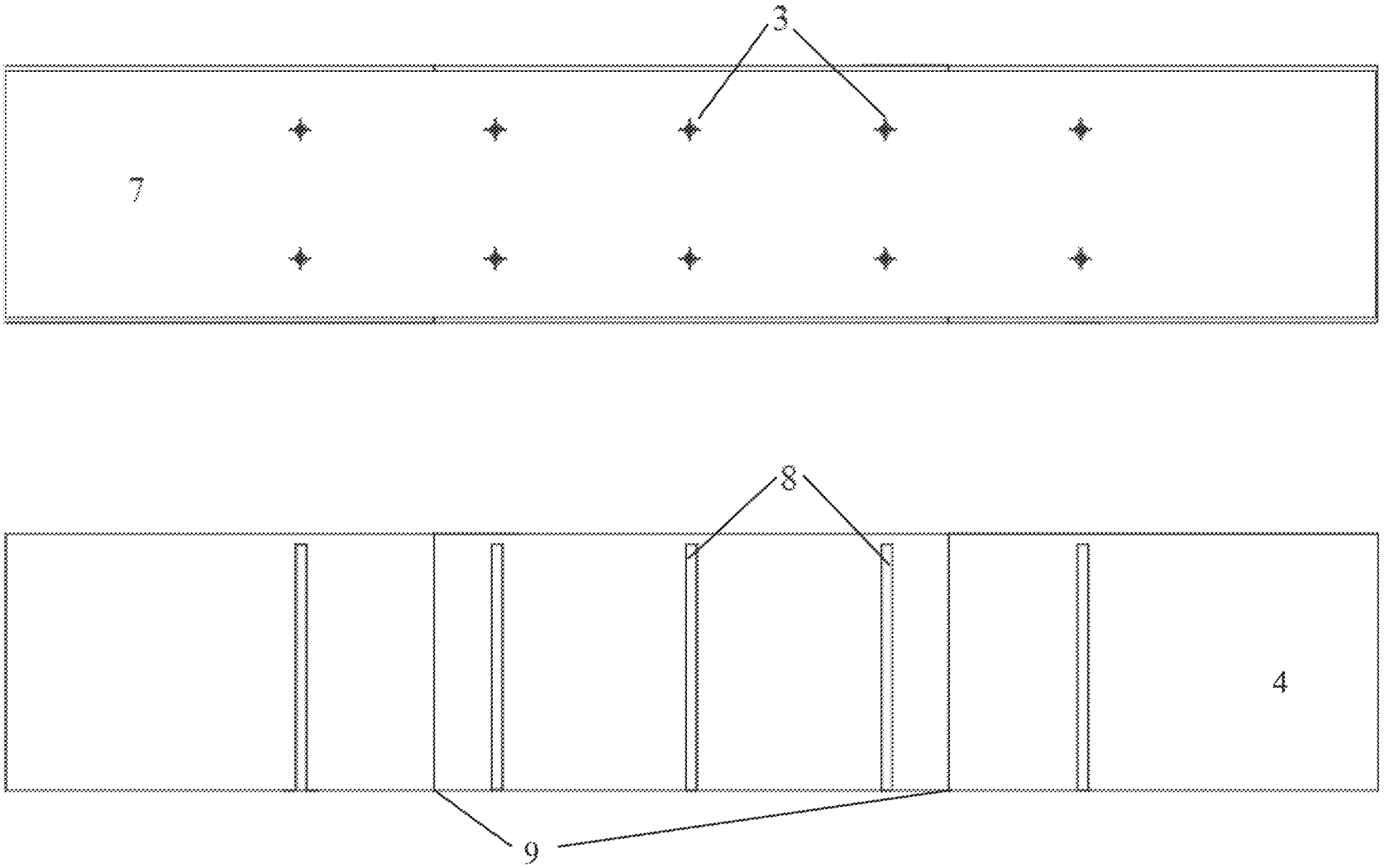
FIG. 4 shows top and bottom plan views of an embodiment of a support refractory layer.

FIG. 1 and FIG. 2 illustrate an embodiment of a section of a roof with three vertically stacked layers 4, 5 and 6. Each of the layers comprises a ceramic refractory material. Although the embodiment illustrated in FIG. 1 has three different layers of ceramic refractory material, other embodiments may include more than three layers of ceramic refractory material, two layers, or a single layer. In an embodiment, each layer may have a thickness of ½ to 4 inches, and the total thickness of the ceramic refractory part of a roof may be from 1 to 12 inches or more.

The different layers may be formed of the same or different materials. For example, since there can be a tradeoff between strength and insulative properties, the lower layer 4 may be formed of a material that is stronger than the upper layers 5 and 6, which may be formed of materials that have better insulative properties and lower strength characteristics than the lower layer 4.

The fibrous ceramic refractory material may include a metal oxide such as aluminum, silicon or zirconium oxide. The ceramic refractory material may be, for example, a porous fiber material with a density of from 200 to 900 $kg/m^3$. Such materials have the advantage of light weight, dimensional stability, ease of machining, temperature resistance and low thermal conductivity. In some embodiments, the ceramic refractory material may have a density of 900 $kg/m^3$ or less, 800 $kg/m^3$ or less, 700 $kg/m^3$ or less, 600 $kg/m^3$ or less, 500 $kg/m^3$ or less, 400 $kg/m^3$ or less, or less than 300 $kg/m^3$.

The uppermost layer in the assembly shown in FIGS. 1-4 is a cover plate 7. The cover plate 7 may be a sheet of aluminum, which has advantages of low weight, cost and high heat dissipation. However, embodiments are not limited to aluminum, and the cover plate 7 may be constructed of other suitable metal and non-metal materials. The cover plate may provide a surface that is readily joined to structural support members such as support beams 21.

Figure 5:
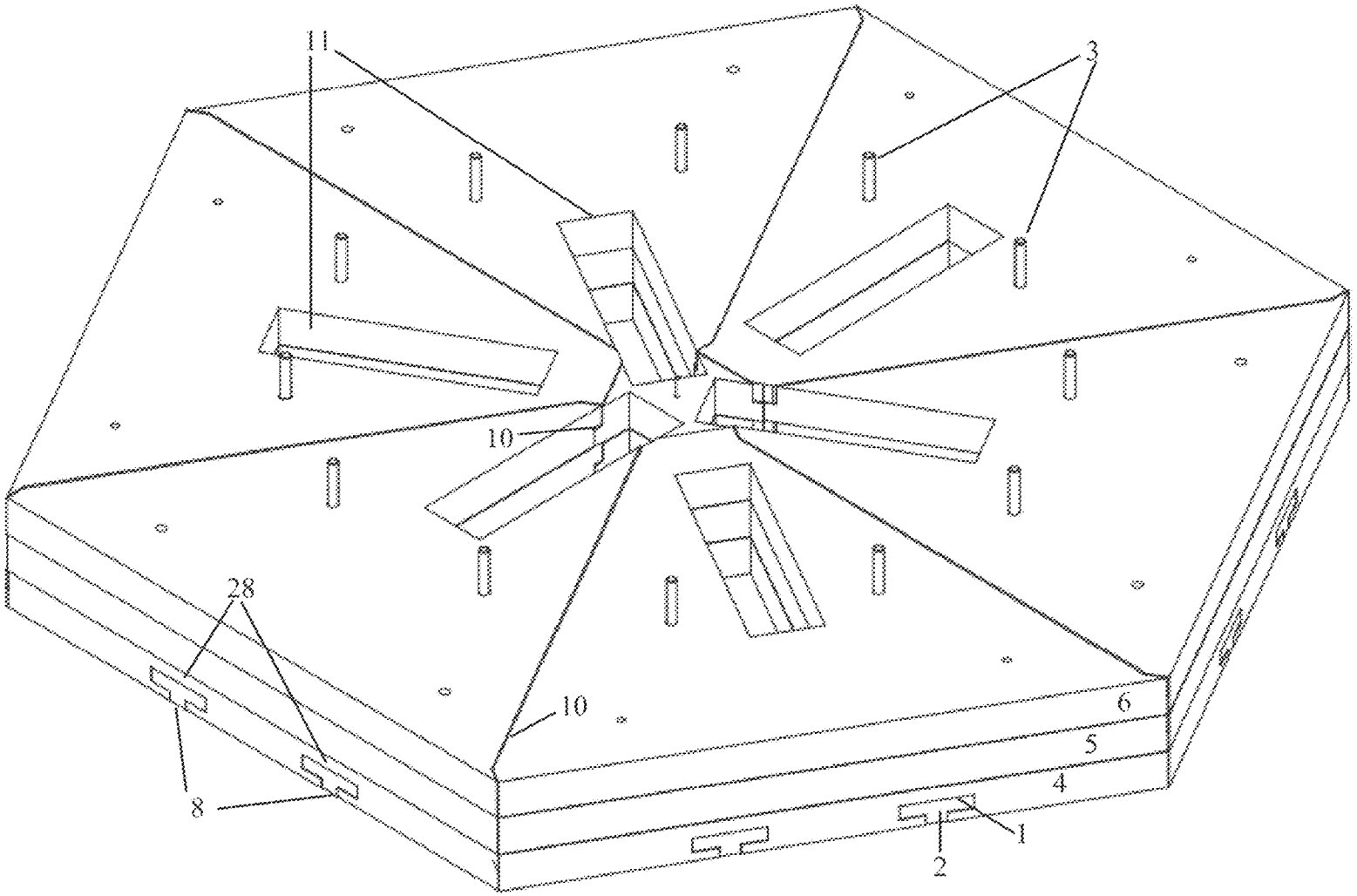
FIG. 5 illustrates a set of refractory boards in a hexagonal roof configuration. This embodiment of the refractory board assembly uses ship-lapping or an inner locking edge 10 on the edges to prevent loss of thermal energy through the roof seams.
Figure 6A:
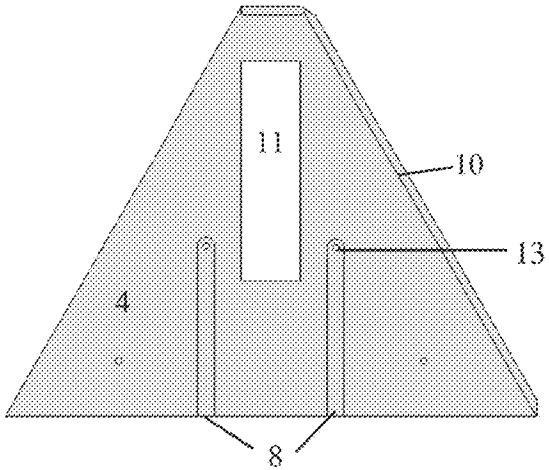
FIG. 6*a* shows a bottom plan view of one of the bottom refractory layer segments 4, showing the ship-lapping 10 and the pockets 8.
Figure 6B:
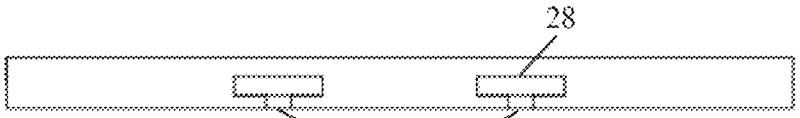
FIG. 6*b* shows a front view of a refractory board segment.
Figure 6C:
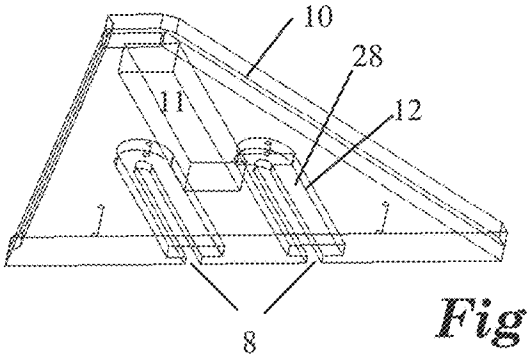
FIG. 6*c* is a wireframe view of the bottom layer refractory board, showing the larger opening 12 within the pocket 8.
Figure 6D:
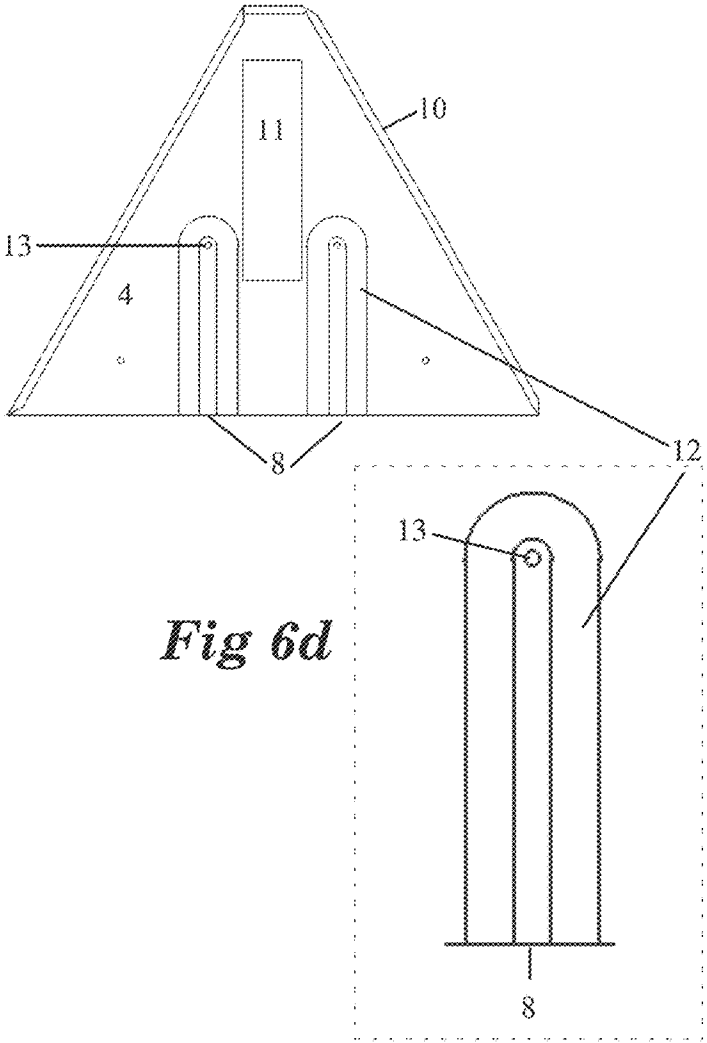
FIG. 6*d* shows a bottom plan view, in wireframe, of the bottom layer refractory, further illustrating the internal hidden radius of the pocket in the detail inset.

A plurality of holes 13 may penetrate the cover plate 7 and refractory layers 4, 5 and 6. At least a portion of the holes may be occupied by suspension rods 3, which may extend from pockets 8 to a point above the upper surface of the cover plate 7. In another embodiment, the suspension rods may have a flanged end that sits on top of or is flush with the upper surface of cover plate 7. While FIG. 5 shows the top side of suspension rods 3 as extending past the upper surface of a roof assembly and being retained to the roof assembly by nuts that are threaded onto the suspension rods, embodiments may comprise various structures for transferring a tensile load between the cover plate 7 and retainers 1.

The suspension rods 3 may comprise a material that has a higher tensile strength than the refractory materials in lower layer 4. For example, the suspension rods may be made of a metal material, a solid ceramic material, or a composite material. Acceptable materials may vary based on the temperatures experienced by the rod, which are affected by the temperature of a thermal process and the thickness of refractory material between the rods 3 and the interior of a thermal chamber, e.g. the thickness of a section of refractory plugs 2.

When the thermal process is a high temperature process such as a melt or casting process, the rods and associated hardware (e.g. washers, nuts, pins) may be formed of 310 stainless steel, which retains more properties at high temperatures than other common grades of stainless steel. In another embodiment, the rods and associated hardware may be made of a high temperature alloy such as Inconel or Hastelloy. In some embodiments, especially when relatively low temperature processes are being performed, the rods may include an organic material such as a fiber reinforced composite.

Ends of the suspension rods 3 may be threaded to accept a nut, flanged, or be configured to accept a pin that provides an expanded surface area in the horizontal dimension. The thickness or diameter of the rods is not restricted, and may be from about one-half centimeter to about three centimeters. The number and thickness or diameter of suspension rods 3 in a particular embodiment may be selected based on the material of the rods, the temperature of the thermal process, the weight of a roof assembly, the size of a thermal chamber, etc. Accordingly, the size and number of rods may vary between embodiments.

The lowermost layer 4 of refractory material may include one or more pocket 8. The pocket 8 may have different widths at different depths. For example, as illustrated by FIG. 2, the pockets 8 may have four different widths. The various widths may limit thermal transfer between the interior of the thermal containment structure and the retainer. In an embodiment, the width at the bottom of the pocket 8, which is the upper side of the pocket in FIG. 2, is the greatest width.

In another embodiment, as seen in FIG. 5, the pockets 8 only have two different widths, including an upper width that is greater than a lower width. The upper width may be sized to accept the shoulder of a refractory plug 2.

The innermost surface of the pockets 8 are thrust surfaces 28 that interface with thrust surface 31 of the retainer (see FIG. 7). The thrust surfaces 28 of the pockets 8 may rest against the upper surface of a retainer 8 to transfer the gravitational load of the refractory layers to the retainer plate.

The refractory plugs 2 may be configured to fit into the pockets 8. The refractory plugs 2 may be formed of the same or a similar refractory material as the lower refractory board layer 4 so that the refractory plugs expand and contract at the same rate as the lower refractory board layer. The refractory plugs 2 may be further configured to provide a gap between the plugs and the thrust surface of the pockets 8 in which the retainers 1 are disposed. The gap may be sized to accommodate a difference in thermal expansion between the material of the retainers 1 and the refractory material of the plugs 2 to prevent physical contact between the retainers and the plugs at elevated temperatures. Similar gaps may be provided between sides of the retainers 1 and sides of the pockets 8.

The retainers 1 may be shaped to fit within the uppermost width of the pockets 8 and the refractory plugs 2. As seen in FIG. 7, the retainers 1 may have a substantially flat upper surface that is penetrated by one or more hole 13. Although the retainer 1 in FIG. 7 only has a single hole 13, in other embodiments, such as the embodiment shown in FIG. 3, two or more holes may penetrate the retainer. The number of holes and size of the retainers may be adapted to ensure that the refractory layers are adequately supported in an assembly 14.

In an embodiment, the retainers 1 are made of a metal material such as a stainless steel, which have superior structural characteristics at elevated temperatures and lower thermal conductivity than metals such as aluminum and copper. In another embodiment, the retainer may be made from a solid ceramic or cermet material.

The suspension rods 3 may interface with the retainers 1 by a nut that is threaded over the suspension rods, a dowel pin driven through the suspension rods, or a bolthead or flange that is disposed on an end of the suspension rods. The retainers 1 may rest on a part that protrudes from the suspension rods, e.g. a nut, dowel pin or flange. In this way, the retainer 1 transfers compressive forces applied by the refractory layer 4 to the relatively large surface area of the thrust surface 31 to the suspension rods 3, so that the suspension rods can support the weight of the refractory boards. Although not shown in the figures, additional materials such as washers or retaining clips may be present in the interface between the suspension rods, retainers and refractory layers.

Figure 7A:
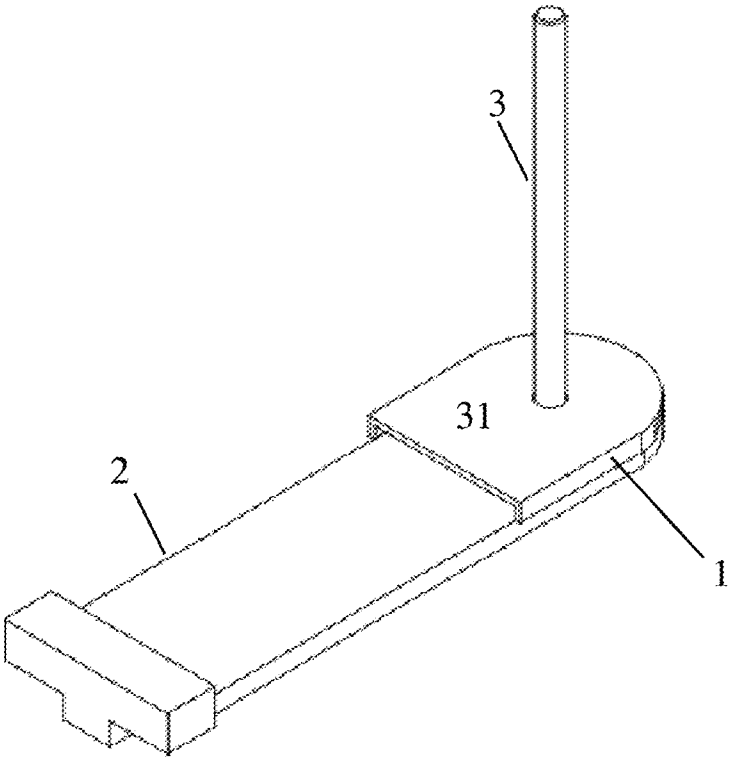
FIGS. 7*a*, 7*b* and 7*c* show views of an example plug, a retainer that will be inserted into a pocket, and a suspension rod which couples the retainer to an upper member of the roof. This configuration conceals the retainer and the suspension rods from exposure to the heat of the furnace. In particular.
Figure 7B:
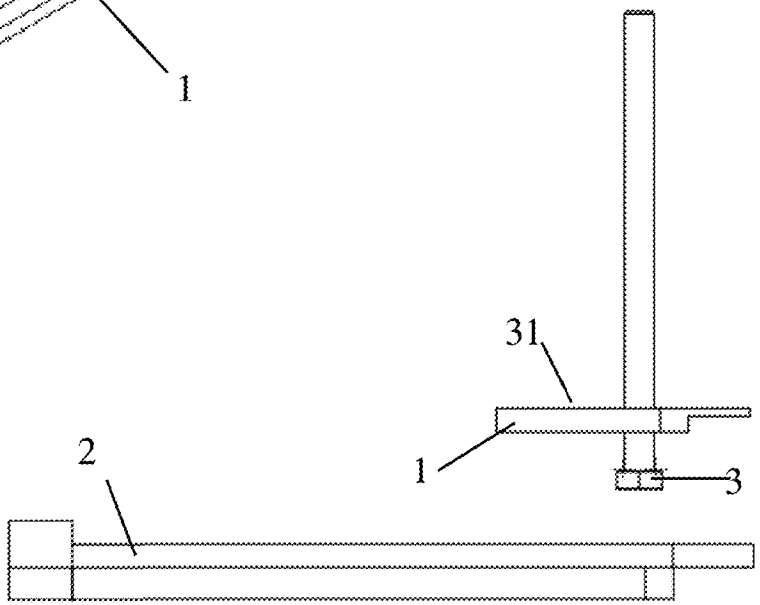
Figure 7C:
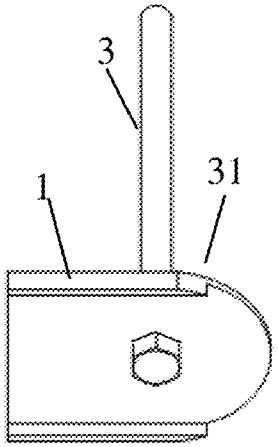

In the embodiment of FIGS. 7*a-c*, the front end of the retainer 1 is a semicircular radius, which may fit within a similar shape at a terminal end of the pocket 8. Such a shape may be advantageous when forming the pockets 8 by a circular cutting device. However, embodiments are not limited to such a configuration. In addition, the retainer in FIGS. 7*a-c* has two siderails, which could be helpful to maintain an orientation between the retainer and the refractory plug 2 when those parts are assembled.

FIG. 5 shows an embodiment of a plurality of refractory layers 4, 5 and 6 in a roof assembly 14. Each layer of refractory material may comprise several different refractory boards. As seen in FIG. 5 and FIGS. 6*a*, 6*c* and 6*d*, the refractory boards may interface with one another by ship lapped joints 10, which can transfer gravitational forces between the boards in a layer and limit thermal transfer. In some embodiments, a refractory slurry may be used to fill gaps that would otherwise be present between the boards, or fill any pockets or irregularities from machining or handling the boards.

Also shown in the embodiment of FIG. 5 are a plurality of cutouts 11. The cutouts 11 may be sized to accommodate radiant emitters 50. In particular, the cutouts 11 may be sized to accommodate an infrared radiant emitter 50. A specific example of an infrared radiant emitter 50 that may be provided in a cutout 11 is described in more detail below with respect to FIG. 12.

When a radiant emitter 50 is disposed in the cutouts 11, the space in the cutouts that is not occupied by the radiant emitter 50 may be filled with insulative material. In another embodiment, the radiant emitters 50 are shaped to fit precisely within the cutouts 11. In an embodiment in which the infrared sources 50 are infrared radiant emitters that include a metal coil embedded within a refractory material, the refractory material of the infrared emitter may fill remaining spaces in the cutouts.

In another embodiment, full-sized cutouts 11 are only provided in one or more lower refractory layer, and upper refractory layers have one or more holes. The holes may accommodate wiring for an infrared radiant emitter 50 and/or suspension rods 3 that suspend the emitters. In an embodiment, the refractory material in which an infrared radiant emitter 50 is embedded precisely fits within a cutout 11, and the wiring for the emitter retains the radiant coil and surrounding refractory material in place against gravitational forces. In some embodiments, an infrared transmissive window may be seated in the pocket 11 that passes infrared energy from an infrared emitter 50 to heat parts within the chamber.

Although the shape of the roof assembly 14 in some of the figures is hexagonal, the shape may be different in other embodiments. For example, the roof assembly 14 may have a square, rectangular or circular shape.

Figure 8:
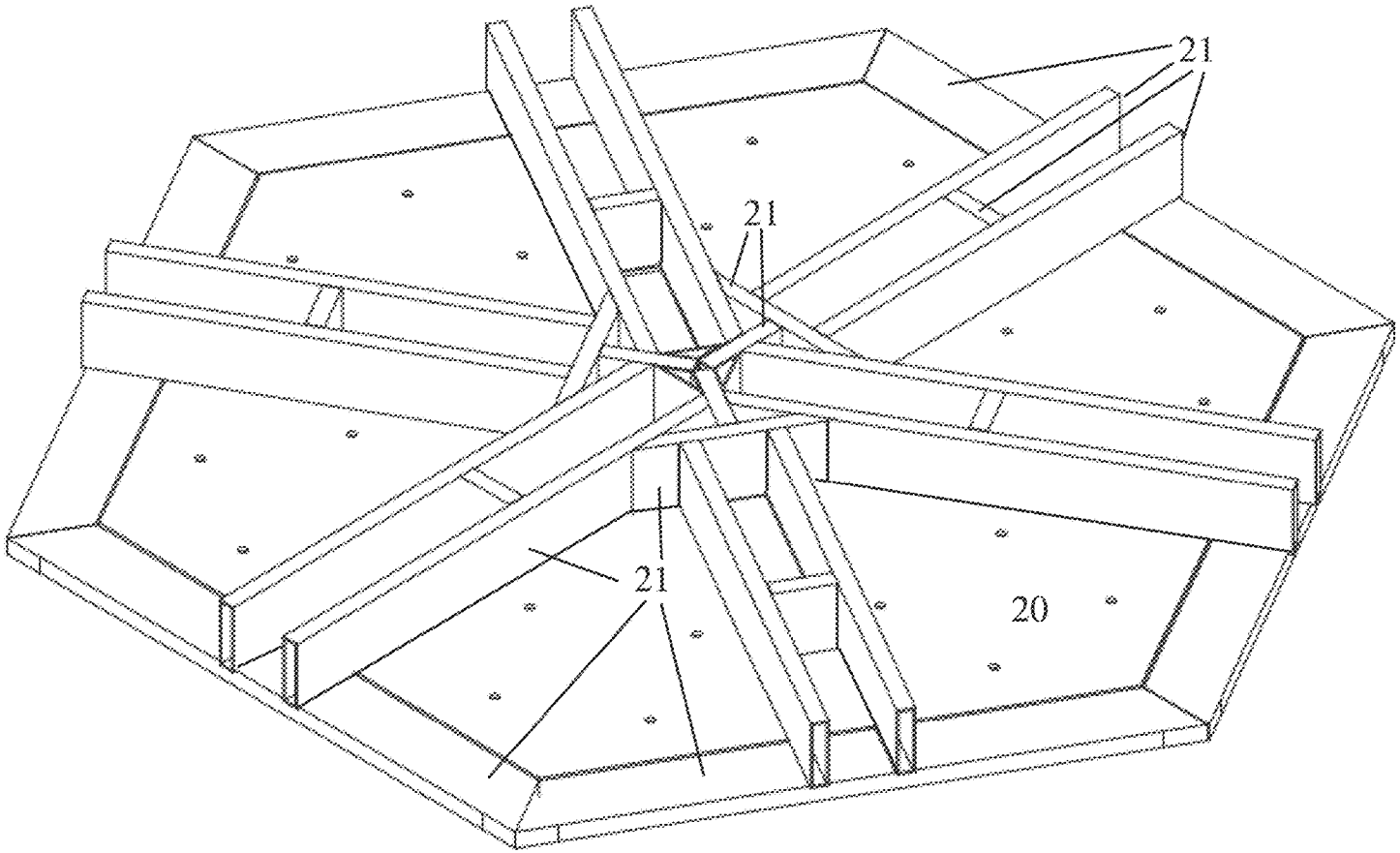
FIG. 8 illustrates an embodiment of a hexagonal roof plate with metal tubing structural members.

FIG. 8 illustrates an embodiment of an exterior structure of a roof assembly including a plate 7 and structural support beams 21 that are coupled to the plate. The embodiment of FIG. 8 shows tubing as support beams 21, but other structures are possible, such as I-beams or solid beams for example. The support beams 21 may be a metal material such as aluminum or steel that provides structural support to the roof at elevated temperatures.

In addition, the support beams 21 may support a furnace structure including a roof and walls when the structure is lifted to provide access to the interior of the structure. In another embodiment, a furnace structure is supported in an elevated orientation by the support beams 21, and one or more part of a floor of the furnace structure is raised and lowered to provide access to the interior of the furnace structure. Persons of skill in the art will recognize that a roof support structure such as the structure shown in FIG. 8 presents many different opportunities to attach to a structure above the roof to suspend the entire roof and walls of a chamber, or to raise and lower the roof and walls. In such embodiments, the roof and walls of the chamber may not have any doors or access ports. Doors are generally weaknesses in thermal insulation, especially at the seams, so embodiments of the present application may have superior thermal characteristics to conventional stationary thermal chambers.

Figure 9:
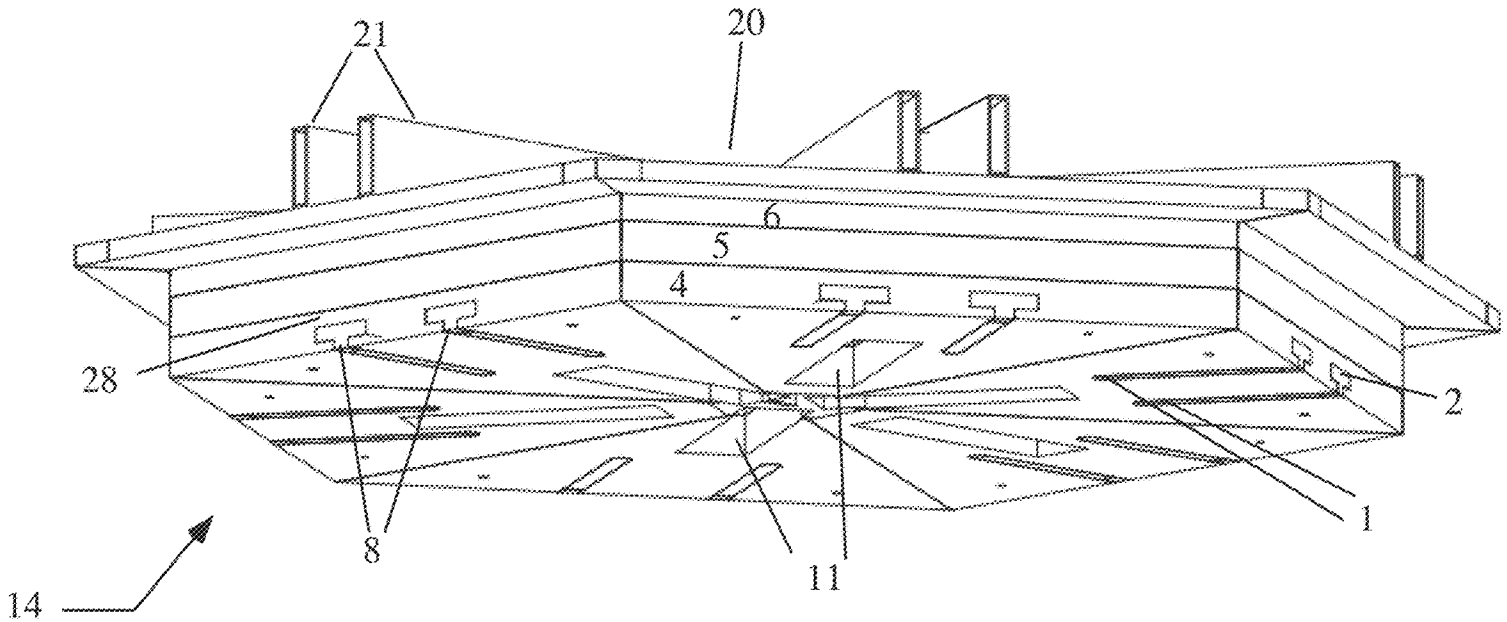
FIG. 9 shows an embodiment of the roof plate assembly of FIG. 8 with three layers of insulating refractory.

FIG. 9 illustrates an embodiment of a roof assembly 14 including the refractory structure shown in FIG. 5 and the roof support structure shown in FIG. 8.

Figure 10:
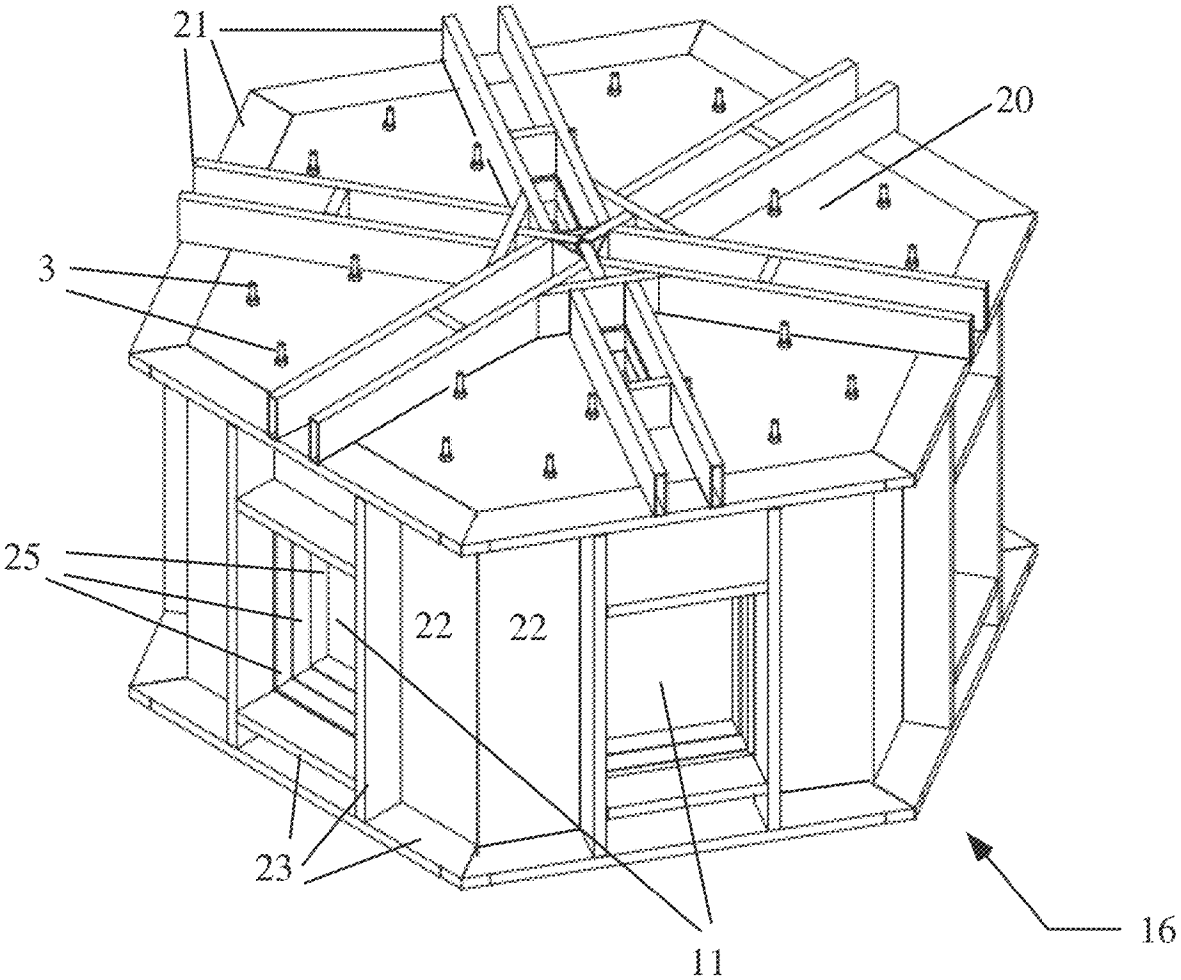
FIG. 10 illustrates an embodiment of a furnace structure. This figure also shows layers of refractory inner walls in addition to the layers of refractory in the ceiling/roof assembly.

FIG. 10 illustrates an embodiment of a high temperature containment structure 16. The structure in FIG. 10 includes the roof assembly 14 from FIG. 9, as well as walls that surround an interior of the structure. The walls include exterior structures 22 which may be sheets of metal such as aluminum or steel, and a plurality of beams 23 that support the wall and foundation structures of the containment structure 16.

FIG. 10 is illustrated with cutouts in the walls that reveal a plurality of layers of refractory material 25 on walls of the structure. The cutouts are provided to illustrate the layers of refractory that insulate the walls, and may not be present in a structure. In an embodiment, one or more window is present in the walls. The walls may lack any access to the interior of the containment structure—access may be provided by lifting the walls and roof of the containment structure, or by removing a floor under the walls.

The refractory material may be arranged in a similar way to the refractory layers discussed with respect to the roof structure—for example, the layers may have ship lapped joints and a plurality of layers of refractory fiberboard may be present. However, the layers may be supported against the force of gravity by a base structure, so embodiments may have no or minimal structural support elements that compress the refractory boards against the exterior structures 22.

Figure 11:
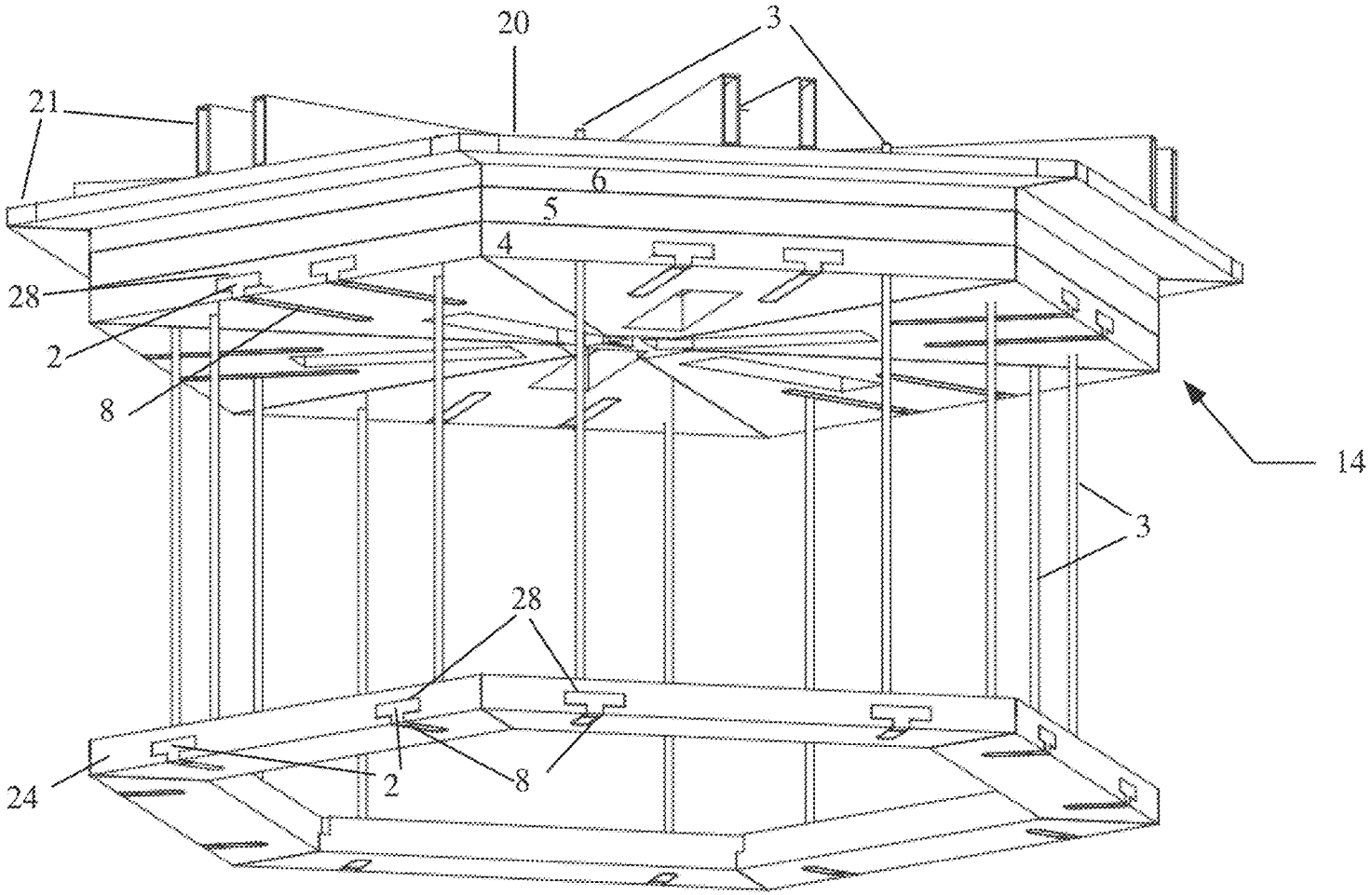
FIG. 11 is the furnace structure of FIG. 10 with exterior walls and foundation removed to show the internal refractory floor as one termination point of the suspension rods that extend through and support the walls, through the roof refractory and the top of the roof plate.

FIG. 11 illustrates an embodiment of a structure that includes a roof assembly 14 that is coupled to a refractory base layer 24. The base layer 24 includes a plurality of pockets 8 and plugs 2 that may be the same as or similar to the pockets 8 and plugs 2 discussed above. One possible difference between the pockets 8 and plugs 2 of the base layer 24 and the roof assembly 14 is that the pockets and plugs of the base layer may be of different length than those of the roof.

The base layer 24 is supported by a second plurality of suspension rods 3. The second plurality of suspension rods 3 coupled to the base layer 24 may be similar to the suspension rods 3 discussed above with respect to the roof assembly 14, except that the suspension rods 3 coupled to the base layer may be stronger than the rods in the roof in order to support a heavier load that includes the inner refractory walls 25. The increased strength could be accomplished by larger rods 3, rods of a different material, or a tighter spacing between rods.

Dimensions of a containment structure 16 may vary depending on the process the structure is used for. If the process is heat treatment of individual parts such as automotive wheels, the interior footprint of a containment structure could be a few square feet. In other embodiments, the structure could have a footprint of tens or hundreds of square feet, and the height could be from several feet to several tens of feet. For example, the interior space of a containment structure 16 may be equal to or greater than four, ten, fifteen, twenty or thirty square feet. The height of the interior space may be equal to or greater than four, six, eight, ten or twelve feet.

Persons of skill in the art will recognize that such variations in size would result in variations to the structure of the embodiments—for example, a larger chamber may use larger support rods and additional layers of refractory material compared to a smaller chamber. In various embodiments, the chamber may be heated from several hundred degrees Fahrenheit to as much as 2,600 degrees Fahrenheit.

Figure 12:
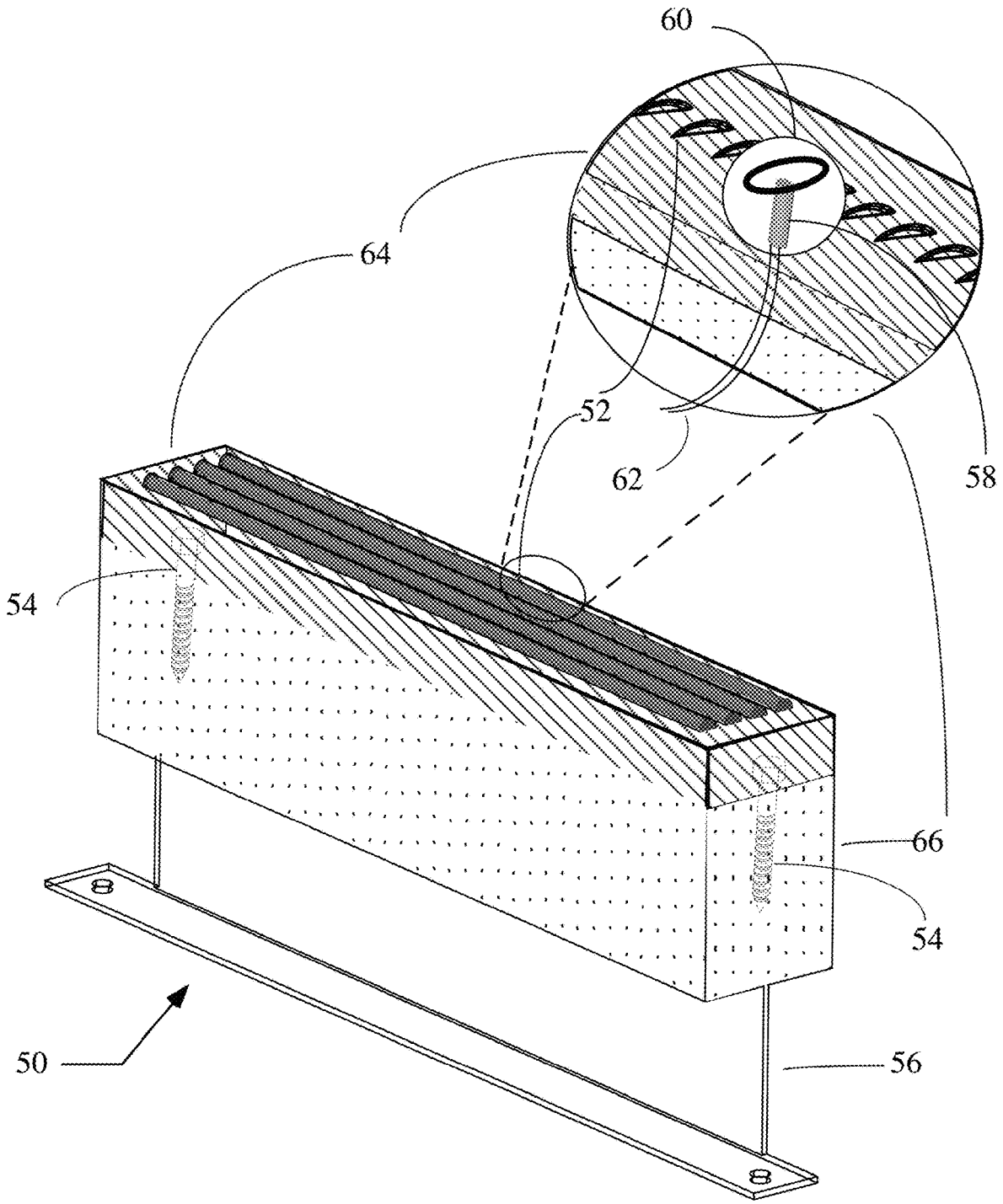
FIG. 12 illustrates an embodiment of an infrared radiant emitter that may be used to heat materials in the containment structure.

FIG. 12 illustrates an embodiment of an infrared radiant emitter 50 that may be one of the first infrared radiant emitters. The infrared radiant emitter 50 may be constructed of coiled wire 52 that has been set in a ceramic matrix or putty 64 along with an in-situ temperature measurement sensor 58. The wire may be Nickel-Chrome, or an equivalent stable resistance vs. temperature material. In an embodiment, only 30 to 40% of each coil sits outside of the ceramic. The configuration shown in FIG. 12 allows the coiled wire 52 to be heated above its plastic deformation temperature.

The infrared radiant emitter 50 may be formed by pouring ceramic into a mold that sits on top of a low-density fibrous ceramic refractory thermal insulator 66. Unlike conventional emitters that use metal retention devices to secure the castable ceramic to low-density ceramic insulation, which have a propensity for delamination because of the incompatibility of the coefficients of expansion, an embodiment of the present disclosure may use one or more pin or screw type retainer 54 constructed from a machinable refractory with a coefficient of expansion which is compatible with the castable ceramic. A metal, e.g. aluminum, backing/mounting 56 may be present, but in such an embodiment the edges near the radiant energy face of the emitter may be refractory coated to form a significant thermal barrier.

Additionally, a temperature sensor 58 in a protective sheath of a material such as Inconel or Stainless Steel may be embedded in the castable ceramic such that it is embedded near center coil 60. Temperature sensor leads 62 are brought out the back of the emitter 50 and routed to a controller which may monitor and control output to the coils. In an embodiment, the protective sheath is in direct contact with a coil.

This construction restricts the emission of the radiant energy to a half cylinder near-Lambertian surface which concentrates the power of the emissions within 45° of normal to the long axis of the emitter for most of the emitter length.

The physical implementation of the coil embedment significantly extends the temperature range or wavelength of the emitter, and the embedded temperature sensor enables a capability for variable but precisely controlled radiant energy output. This capability contributes to the optimum tunability of the infrared radiant emitters 50 and enables the reliable projection of infrared radiant energy through the pass band of the ceramic glass material. The effective tunability of the radiant emitters spans a temperature range from less than 500° F. (260° C.) to more than 2,200° F. (1,200° C.), and can be controlled to an accuracy of less than 2° C.

In an embodiment, the coils 52 have a coil diameter of 12 to 17 wire diameters. The coils 52 are set inside a ceramic refractory 64 that is "cast" with the coils partially submerged into the ceramic refractory, such that only a length of wire equal to about 12 to 17 diameters of the wire is exposed to radiate above the common surface of the castable ceramic refractory 64 in an array of evenly spaced and co-aligned arcs. The wire coils may be positioned in, and supported by, the ceramic such that the surface tension of the coils overcomes plastic deformation for the selected range of heating.

The ceramic may be poured into a molded or machined ceramic insulator 66 that is from about 18 mm to 25 mm or thick. This shell serves to provide a structure that can accept the over-mold of the castable ceramic that is used to cover the radiant emitter. Machined grooves may be cut into the machinable refractory thermal insulator to assist manufacturing and the ceramic insulator 66 effectively minimizes the transmission of thermal energy from the embedded emitter to the space behind the radiant emitter.

The performance of the infrared radiant emitter 50 shown in FIG. 12 is significant. The limited exposure (approximately 30% of each coil is exposed outside of the ceramic) of the resistive wire coil segments provides a restricted surface area from which the radiant energy created by the current flow through the (resistive) element can escape.

In this implementation, the ceramic matrix additionally provides physical support to most of each coil's radiant surface. This feature allows reliable operation above the plastic deformation temperature of the resistive element, such as nickel chromium alloy or some resistive conductor chosen for its robust thermal performance. These superheated coil segments are light enough that surface tension becomes a factor enabling the coils to maintain their shape against gravity and thus overcome plastic deformation and approximately doubling the useful temperature range of the emitter.

This construction restricts the emission of the radiant energy to around one third of the radiant emitter's surface area. The high performance castable ceramic refractory 64 quickly heats up to nearly the temperature of the radiant wire, minimizing the radiant transfer of energy to the ceramic, because only a portion of the radiant emitter is exposed to a lower temperature heat sink opportunity. By the Stefan-Boltzmann Law, the effectiveness of radiant energy transfer is proportional to the fourth power of the difference in temperature between the emitter and the receiver. This physical construction restricts the exposed portions of the radiant emitter to be the only path for the thermal energy to exit the radiant emitter 50.

Since less than half of the radiant surface of the conductor through which the electrical current is flowing is available as a pathway for radiant energy release, the intensity or power per unit area is driven up to approximately double the typical operating temperature for a given element and a stated current flow. A Lambertian surface emits radiant energy as a cosine function of the viewing angle normal to the surface—as such, more than 70% of the radiant energy released by the radiant emitter 50 is projected within 45 degrees of normal to the radiant surface.

The radiant energy from the inner side of each coil 52 is exposed directly to the surface of the high thermal-capacity, low thermal-conductivity refractory material 64. The refractory 64 quickly heats up and becomes a thermal energy radiator at nearly the same temperature as the radiant emitter. Although the refractory material 64 is a significant insulator and conducts very little heat away from the emitter, by the Stephen-Boltzmann law it also couples very little heat into the material from the radiant emitter.

Embodiments of the present disclosure provide many advantages to conventional high temperature chambers. Embodiments have greater longevity than the cast materials that are typical in conventional operations, and can be constructed at a much lower cost. The inventors have found that cost savings can exceed an order of magnitude of the costs of conventional operations.

The efficiency of embodiments of the present disclosure is substantially greater than conventional chambers, resulting in substantially reduced energy consumption and a much more comfortable operating environment. Efficiency can be improved by up to two orders of magnitude compared to conventional chambers. Since some embodiments can be lifted or maintained in a raised orientation, it is much easier to service, load and maintain embodiments of the present disclosure. In addition, the use of materials with efficient thermal transfer such as aluminum present opportunities to recover a substantial portion of the energy used to heat the chambers, further reducing costs and facilitating compliance with environmental regulations, as well as being better for the environment.

The invention claimed is:

1. A furnace structure comprising:

a roof assembly of at least one layer of refractory material, and a metal plate that covers the at least one layer of refractory material and is configured to dissipate heat from the furnace structure;

a plurality of sidewalls fixed to the roof assembly, each of the sidewalls comprising refractory material at an interior surface and a metal wall plate at an outer surface; and a plurality of infrared emitters disposed in at least one of the sidewalls and the roof assembly, wherein the furnace structure including the roof assembly and the plurality of sidewalls is configured to be repeatedly separated from and placed in contact with a supporting floor to provide access to an interior of the furnace structure.

2. The furnace structure of claim 1, wherein the roof assembly is configured to support the plurality of sidewalls when the furnace structure is separated from the supporting floor.

3. The furnace structure of claim 2, wherein the roof assembly comprises a plurality of structural support beams that are coupled to support rods of the sidewalls.

4. The furnace structure of claim 1, wherein the roof assembly and the plurality of sidewalls do not have any doors or access ports.

5. The furnace structure of claim 1, further comprising:

a plurality of sidewall suspension rods that couple the roof assembly to a refractory base layer that is disposed at a base of the plurality of sidewalls.

6. The furnace structure of claim 1, wherein the at least one layer of refractory material includes a first layer of refractory boards and a second layer of refractory boards, and wherein seams between adjacent boards of the first layer of refractory boards are staggered with respect to adjacent boards of the second layer of refractory boards.

7. The furnace structure of claim 1, wherein the at least one layer of refractory material includes a first layer of refractory boards and a second layer of refractory boards, wherein seams between adjacent boards of the first layer of refractory material ship-lapped, and wherein seams between adjacent boards of the first layer of refractory material ship-lapped.

8. The furnace structure of claim 1, further comprising:

a plurality of roof suspension rods that suspend a lowermost layer of the at least one layer of refractory material from the metal plate in the roof assembly, wherein the metal plate is thermally coupled to the roof suspension rods so that the metal plate dissipates heat received from the roof suspension rods when the furnace is heated.

9. The furnace structure of claim 1, wherein a footprint of an interior space of the furnace structure is at least four square feet, and the furnace structure has an operating temperature of at least 1000° F.

10. A furnace structure comprising:

a roof assembly of at least one layer of refractory material, a metal plate that covers the at least one layer of refractory material and is configured to dissipate heat from the furnace structure, and a first plurality of infrared emitters;

a plurality of sidewalls fixed to the roof assembly, each of the sidewalls comprising refractory material at an interior surface and a metal wall plate at an outer surface; and a second plurality of infrared emitters disposed in at least one of the sidewalls, wherein the furnace structure including the roof assembly and the plurality of sidewalls is configured to be repeatedly separated from and placed in contact with a supporting floor to provide access to an interior of the furnace structure.

11. The furnace structure of claim 10, wherein the roof assembly is configured to support the plurality of sidewalls when the furnace structure is separated from the supporting floor.

12. The furnace structure of claim 11, wherein the roof assembly comprises a plurality of structural support beams that are coupled to support rods of the sidewalls.

13. The furnace structure of claim 11, wherein the roof assembly and the plurality of sidewalls do not have any doors or access ports.

14. The furnace structure of claim 11, further comprising:

a plurality of sidewall suspension rods that couple the roof assembly to a refractory base layer that is disposed at a base of the plurality of sidewalls.

15. The furnace structure of claim 10, wherein the at least one layer of refractory material includes a first layer of refractory boards and a second layer of refractory boards, and wherein seams between adjacent boards of the first layer of refractory boards are staggered with respect to adjacent boards of the second layer of refractory boards.

16. The furnace structure of claim 10, wherein the at least one layer of refractory material includes a first layer of refractory boards and a second layer of refractory boards, wherein seams between adjacent boards of the first layer of refractory material are ship-lapped.

17. The furnace structure of claim 10, further comprising:

a plurality of roof suspension rods that suspend a lowermost layer of the at least one layer of refractory material from the metal plate in the roof assembly, wherein the metal plate is thermally coupled to the roof suspension rods so that the metal plate dissipates heat received from the roof suspension rods when the furnace is heated.

18. The furnace structure of claim 10, wherein a footprint of an interior space of the furnace structure is at least four square feet, and the furnace structure has an operating temperature of at least 1000° F.

19. A furnace structure comprising:

a roof assembly of at least one layer of refractory material, and a metal plate that covers the at least one layer of refractory material and is configured to dissipate heat from the furnace structure;

a plurality of sidewalls fixed to the roof assembly, each of the sidewalls comprising refractory material at an interior surface and a metal wall plate at an outer surface;

a plurality of infrared emitters disposed in an opening in at least one of the refractory material of the sidewalls and the refractory material of the roof assembly; and a plurality of roof suspension rods that suspend a lowermost layer of the at least one layer of refractory material from the metal plate in the roof assembly, wherein the metal plate is thermally coupled to the roof suspension rods so that the metal plate dissipates heat received from the roof suspension rods when the furnace is heated.

* * * * *